US006078779A

United States Patent [19]

Hachisuga

[11] Patent Number: 6,078,779

[45] Date of Patent: Jun. 20, 2000

[54] IMAGE FIXING APPARATUS WITH AN OIL COATER FOR COATING AN IMAGE FIXER

[75] Inventor: Takaaki Hachisuga, Yokohama, Japan

[73] Assignees: Toshiba Tec Kabushiki Kaisha, Tokyo; Kabushiki Kaisha Toshiba, Kawasaki, both of Japan

[21] Appl. No.: 09/318,122

[22] Filed: May 25, 1999

[30] Foreign Application Priority Data

May 25, 1998 [JP] Japan ..... 10-142920

[51] Int. Cl.[7] ..... G03G 15/20

[52] U.S. Cl. ..... 399/325; 118/60

[58] Field of Search ..... 399/24, 122, 324–326; 118/60, DIG. 1

[56] References Cited

U.S. PATENT DOCUMENTS 4,994,862 2/1991 Hoover ..... 118/60 X
5,559,591 9/1996 Kato et al. ..... 399/327
5,678,152 10/1997 Kohno et al. ..... 399/324
5,698,320 12/1997 Ebisu et al. ..... 399/325
5,749,036 5/1998 Yoda et al. ..... 399/325

FOREIGN PATENT DOCUMENTS 9-80943 3/1997 Japan .

*Primary Examiner*—William J. Royer
*Attorney, Agent, or Firm*—Foley & Lardner

[57] ABSTRACT

A fixing unit includes a fixing roller for fixing an image of a developer transferred onto a transfer medium, an oil coating unit for coating the fixing roller with oil to prevent the developer from attaching thereto, and an attaching frame for detachably attaching the oil coating unit to the fixing roller. The oil coating unit includes a plurality of supply rollers that contain oil, and a removing roller for removing the developer attached to the supply rollers.

21 Claims, 3 Drawing Sheets

IMAGE FIXING APPARATUS WITH AN OIL COATER FOR COATING AN IMAGE FIXER

BACKGROUND OF THE INVENTION

This invention relates to a fixing unit and an image forming apparatus for use in, for example, an electrophotographic color copy machine or a color printer.

In a fixing unit used in an electrophotographic color copy machine or a color printer, a fixing roller is coated with a great amount of silicone oil in order to prevent the toner from attaching thereto. Although there are various types of methods for the coating of silicone oil, the following method is generally used:

First, silicone oil is pumped from an oil tank by an oil pump, and dripped onto oil coating felt. The oil then permeates the felt and sticks to an oil supply roller, where the oil is made to a predetermined thickness by a regulating blade. After that, it is applied to a fixing roller via a coating roller.

The oil, made to come off the oil supply roller by the blade, drips into an oil pan and returns to the oil tank to be used again. After the oil tank becomes empty, it is replenished with new oil.

In the conventional case, however, supplementary oil is supplied into the oil tank through a filling port provided therein. Accordingly, it is highly possible that the oil will spill from the tank and soil its peripheral components.

This being so, the oil replenishing work is liable to be shunned by a general user and is usually performed by a professional maintenance worker. When the professional maintenance worker does it, the downtime of a printer, a copy machine, etc. becomes too long to ignore.

Also, even where the professional maintenance worker exchanges a dirty oil-soaked felt with a new one, oil may spill from the felt when removed since a great amount of oil is absorbed in it.

In addition, since oil remains in the oil pan, it will spill therefrom if the fixing unit inclines while, for example, the unit is moved.

BRIEF SUMMARY OF THE INVENTION

The invention has been developed in light of the above-described problems, and is aimed at providing a fixing unit and an image forming apparatus, which are equipped with oil coating means that even a general user can replace without spilling oil, and which do not spill oil even when they are inclined.

According to a first aspect of the invention, there is provided a fixing unit comprising: fixing means for fixing an image of a developer transferred on a transfer medium; oil coating means for coating the fixing means with oil to prevent the developer from attaching to the fixing means; and attaching means for detachably attaching the oil coating means to the fixing means.

According to a second aspect of the invention, there is provided a fixing unit comprising: fixing means for fixing an image of a developer transferred on a transfer medium; oil coating means for coating the fixing means with oil to prevent the developer from attaching to the fixing means, the oil coating means including coating roller means which contains oil, and a removing roller for removing the developer attached to the coating roller; and attaching means for detachably attaching the oil coating means to the fixing means.

According to a third aspect of the invention there is provided an image forming apparatus comprising: a plurality of image carriers for carrying images; a plurality of image forming means for forming developer images of different colors on the image carriers; a plurality of transfer means for transferring the developer images formed by the image forming means, onto a transfer medium; fixing means for fixing the developer images transferred to the transfer medium by the transfer means; oil coating means for coating the fixing means with oil to prevent the developer from attaching to the fixing means, the oil coating means including coating rollers which contain oil, and a removing roller for removing the developer attached to the coating roller; attaching means for detachably attaching the oil coating means to the fixing means; and count means for counting the life of the oil coating means.

By virtue of the above-described structures, even a general user, as well as a professional maintenance worker, can replace the oil coating means without spilling oil from the fixing unit. Therefore, the downtime of the apparatus can be minimized.

Further, oil leakage can be prevented even when the fixing unit is inclined, thereby enhancing the reliability of the unit.

In addition, the surfaces of the coating rollers can be prevented from contamination, which enables supply of constant oil to the fixing roller.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The embodiment of the invention will be described with reference to the accompanying drawings.

Figure 1:
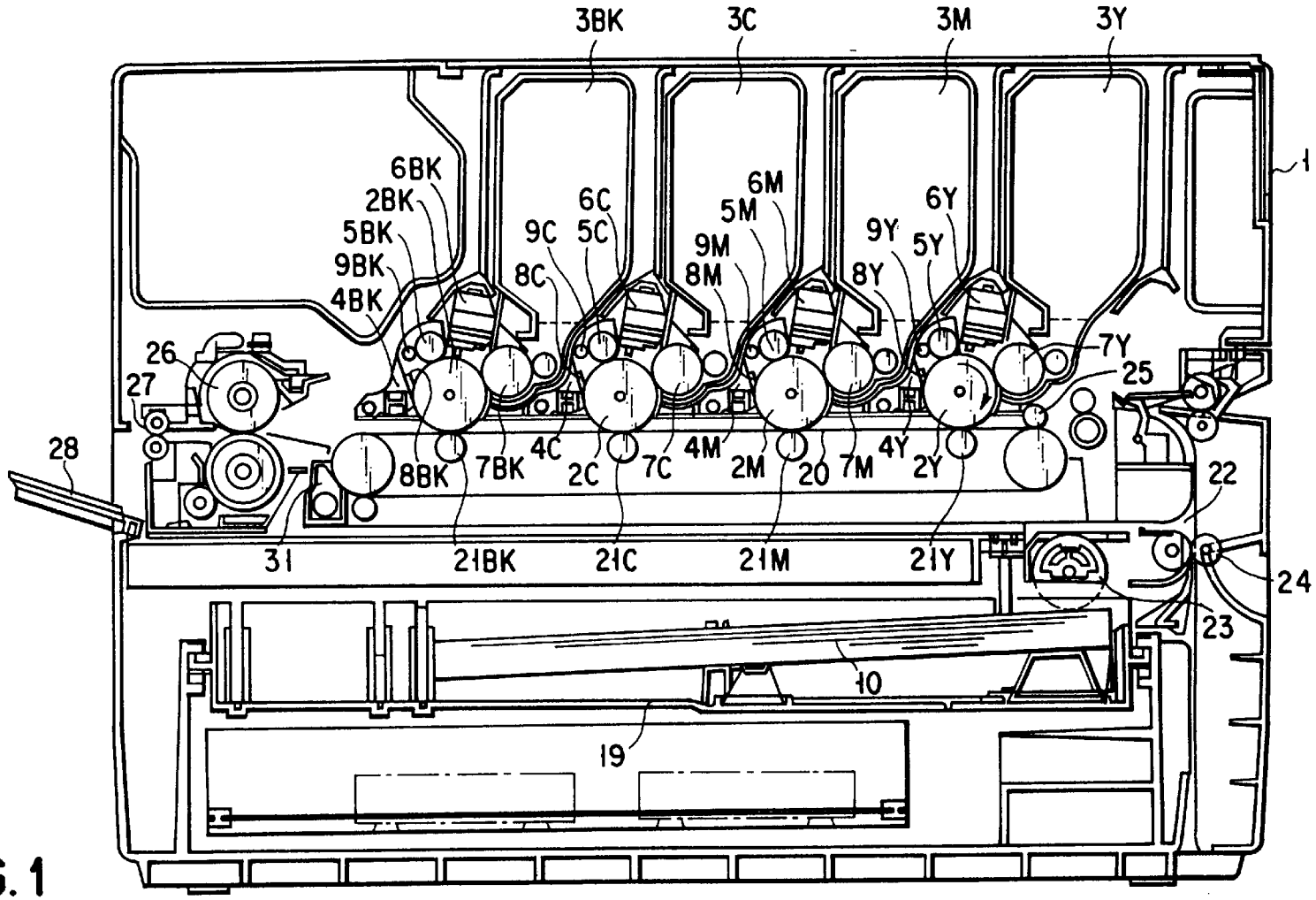
FIG. 1 is a schematic view illustrating an electrophotographic color copy machine according to the embodiment of the invention.

FIG. 1 shows the entire structure of an electrophotographic color copy apparatus. As shown, an apparatus main body 1 houses photosensitive drums 2Y, 2M, 2C and 2BK as image carriers such that they are arranged at regular intervals. Recording units 3Y, 3M, 3C and 3BK for recording images in four colors, i.e. yellow (Y), magenta (M), cyan (C) and black (BK), are arranged parallel to each other and opposed to the photosensitive drums 2Y, 2M, 2C and 2BK, respectively. The recording units 3Y, 3M, 3C and 3BK have the same structure. Therefore, a description will be given of only the yellow image recording unit 3Y located upstream of the other recording units. Concerning the other recording units 3M, 3C and 3BK, only reference signs 3M, 3C and 3BK are attached after the unit 3Y and duplicate description of them will be omitted.

The recording unit 3Y includes the photosensitive drum 2Y and image forming means 4Y provided corresponding thereto for repeatedly forming a yellow image on the photosensitive drum 2Y. The image forming means 4Y comprises a charging unit 5Y, an exposing unit 6Y, a developing unit 7Y, a cleaning unit 8Y, a deelectrifying unit 9Y, etc.

A transfer conveyance belt 20 as transfer medium conveying means is extended below each recording unit 3Y, 3M, 3C or 3BK. The transfer conveyance belt 20 conveys, to each of the photosensitive drums 2Y, 2M, 2C and 2BK, a paper sheet 10 as a transfer medium onto which an image is to be transferred.

Further, transfer units 21Y, 21M, 21C and 21BK as transfer means are opposed to the photosensitive drums 2Y, 2M, 2C and 2BK, respectively, with the transfer conveyance belt 20 interposed therebetween. Toner images in the colors Y, M, C and BK are transferred onto the paper sheet 10 conveyed by the transfer conveyance belt 20.

The paper sheet 10 is fed from a paper feed system 22 onto the conveyance belt 20 at a predetermined point in time. The paper feed system 22 includes a pick-up roller 23 for picking up paper sheets 10 from a paper feed cassette 19, and a forwarding roller pair 24 for forwarding each paper sheet 10 picked up by the pick-up roller 23. The paper feed system 22 also includes a resist roller pair 25 for adjusting the front end of each paper sheet 10 forwarded by the forwarding roller pair, and further forwarding the adjusted paper sheet at a predetermined point in time.

The sheet conveyance rate of the resist roller pair 25 and the transfer conveyance belt 20 is set equal to the peripheral speed of each photosensitive drum 2Y, 2M, 2C or 2BK.

A fixing unit 26, a paper discharging roller pair 27 and a discharge tray 28 are arranged in the transfer medium conveying direction (leftward in FIG. 1) of the transfer conveyance belt 20. Further, a control unit (not shown) is provided in the apparatus main body 1 on its bottom for controlling the operations of the recording units 3Y, 3M, 3C and 3BK, the paper feed system 22 and other components.

When in the above-described structure, color image forming has been instructed from an operation input section (not shown), the recording units 3Y, 3M, 3C and 3BK respectively corresponding to yellow (Y), magenta (M), cyan (C) and black (BK) operate at predetermined points in time, thereby forming toner images in the colors Y, M, C and BK onto the photosensitive drums 2Y, 2M, 2C and 2BK, respectively.

Taking the recording unit 3Y as an example, the photosensitive drum 2Y rotates clockwise (in a direction indicated by the arrow in FIG. 1), whereby the surface of the drum is uniformly charged with electricity by the charging unit 5Y. Then, the uniformly charged surface of the photosensitive drum 2Y is subjected to exposure by the exposing unit 6Y, thereby forming a latent image corresponding to a yellow image. This latent image is developed when it is opposed to the developing unit 7Y, thereby forming a yellow toner image on the photosensitive drum 2Y. Similarly, toner images are formed in the other recording units 3M, 3C and 3BK.

On the other hand, in synchronism with the toner image forming operation, a paper sheet 10 is picked up from the paper feed cassette 19. This paper sheet 10 is forwarded onto the transfer conveyance belt 20 after its front end is adjusted by the resist roller pair 25.

The paper sheet 10 guided onto the transfer conveyance belt 20 is conveyed by it, electrostatically attached thereto by an electrostatically holding roller (not shown). The paper sheet 10 is first guided to a yellow toner image transfer position, i.e. a position in which the photosensitive drum 2Y is opposed to the transfer unit 21Y with the transfer conveyance belt 20 interposed therebetween. In this yellow toner image transfer position, the paper sheet 10 contacts a yellow toner image on the drum 2Y. At this time, the transfer unit 21Y causes the yellow toner image on the drum 2Y to be transferred onto the paper sheet 10.

The transfer unit 21Y consists of a semiconductive transfer roller, and is adapted to supply, from the reverse side of the conveyance belt 20, the yellow toner image electrostatically held on the photosensitive drum 2Y with an electric field having a polarity opposite to that of the yellow toner image. This electric field acts on the yellow toner image on the photosensitive drum 2Y through the conveyance belt 20 and the paper sheet 10, with the result that the yellow toner image is transferred from the drum 2Y onto the paper sheet 10.

The paper sheet 10 with the yellow toner image transferred thereon is then conveyed to the toner image transfer position of each recording unit 3Y, 3M, 3C and 3BK in this order. As a result, in the same manner as above, a magenta toner image, a cyan toner image and a black toner image are sequentially transferred onto the paper sheet. Thus, a color image is formed on it.

The paper sheet 10 with the color toner image formed thereon is separated from the transfer conveyance belt, and guided to the fixing unit 26. In the fixing unit 26, the color toner image consisting of overlapping toner images is permanently fixed. After the fixing process, the paper sheet 10 is discharged into the discharge tray 28.

On the other hand, the transfer conveyance belt 20 is kept rotating after the transfer medium is separated, whereby remaining toner or fine paper particles are cleaned by a belt cleaning unit 31. After the cleaning, the transfer conveyance belt 20 is deelectrified by the deelectrifying roller (not shown) to make the potential of the belt surface uniform.

The photosensitive drums 2Y, 2M, 2C and 2BK are kept rotating after the toner images are transferred therefrom, and remaining toner or paper dust particles attached thereto are cleaned by the cleaning units 8Y, 8M, 8C and 8BK. After the cleaning, the photosensitive drums 2Y, 2M, 2C and 2BK are deelectrified by the deelectrifying units 9Y, 9M, 9C and 9BK such that their surfaces have a uniform potential. After that, the above-described series of processes are repeated, if necessary, by the units beginning from the charging units 5Y, 5M, 5C and 5BK.

Figure 2:
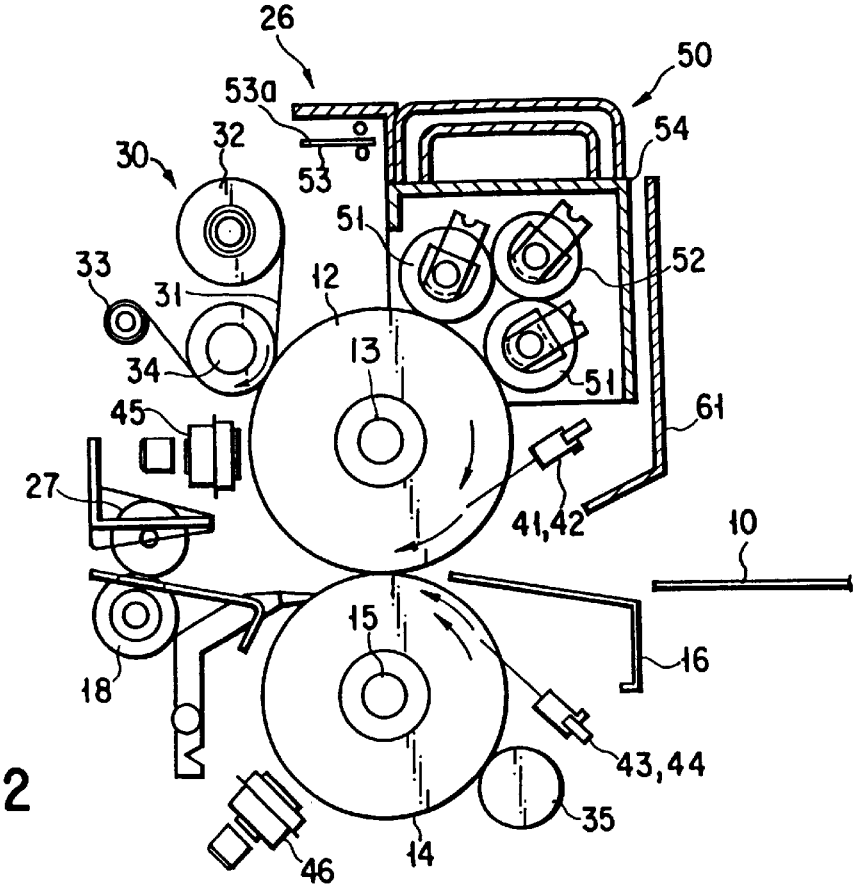
FIG. 2 is a view illustrating a fixing unit incorporated in the machine of FIG. 1.

FIG. 2 shows the fixing unit 26 employed in the invention.

The fixing unit 26 is adapted to heat a developed image on the paper sheet 10 to a predetermined fixing temperature, and then to urge the image against the sheet so as to fix it thereon.

The fixing unit 26 includes a fixing roller 12 as fixing means which has an axis of rotation extending in a direction perpendicular to the conveyance direction of the paper sheet 10. A back-up roller 14 is provided just below the fixing roller 12 and urged against it by a predetermined pressure. The fixing roller 12 and the back-up roller 14 are each formed by coating a cylindrical roller made of a material of a high thermal conductivity such as aluminum, with a material which has a high release characteristic, such as silicone rubber, tetrafluoroethylene resin, etc.

The fixing roller 12 is rotated by, for example, a driving motor (not shown) at a predetermined speed in a direction indicated by the arrow in FIG. 2. The back-up roller 14 is driven to rotate by the fixing roller 12. Halogen lamps 13 and 15 as heat sources are concentrically provided at central portions of the fixing roller 12 and the back-up roller 14, respectively. The surfaces of the fixing roller 12 and the back-up roller 14 are controlled to a predetermined temperature by the on/off control of the halogen lamps 13 and 15, respectively.

The fixing roller 12 and the back-up roller 14 are vertically opposed to each other, with the sheet conveyance path interposed therebetween. A guide plate 16 is provided before the fixing roller 12 for guiding the paper sheet 10 between the fixing roller 12 and the back-up roller 14.

When fixing, the paper sheet 10 is conveyed along the guide plate 16 and passed through a nip section where the fixing roller 12 contacts the back-up roller 14. During being passed therethrough, the developed image on the paper sheet 10 is heated and urged against the sheet. As a result, the image is fixed on it. After the fixing process, the paper sheet 10 is discharged to the outside of the machine via a pair of discharge rollers 27, 18.

On the other hand, a cleaning mechanism 30 for cleaning the fixing roller 12 is provided obliquely above the fixing roller 12. The cleaning mechanism 30 has a web 31 formed of nonwoven fabric. The web 31 is wound on a forwarding roll 32 and is little by little rewound therefrom by a winding roll 33. During being rewound, the web 31 is urged against the fixing roller 12 by an urging roller 34. Thus, the web 31 is made to run on the fixing roller 12, thereby cleaning its surface.

A cleaning roller 35 is rotatably urged against the back-up roller 14 to clean the surface of the roller 14.

Central thermistors 41 and 43 are provided near substantially central portions of the fixing roller 12 and the back-up roller 14, respectively, while end thermistors 42 and 44 are provided near end portions of the rollers 12 and 14, respectively. The central and end thermistors 41–44 detect the surface temperatures of the fixing roller 12 and the back-up roller 14.

Thermostats 45 and 46 are provided near the surfaces of the fixing roller 12 and the back-up roller 14 for forcibly turning off the halogen lamps 13 and 15 in the rollers 12 and 14 when the thermistors 41–44 detect any abnormal temperature. Thus, the stability of the apparatus is enhanced.

An oil coating unit 50 as oil supply means is provided on the downstream side of the cleaning mechanism 30 with respect to the rotational direction of the fixing roller 12. The oil coating unit 50 has a case 54, and a pair of coating rollers 51, as supply rollers, contained in the case.

The coating rollers 51 are urged against the fixing roller 12 by a pressure spring (not shown). Further, a cleaning roller 52 as a rotatable removing roller contacts the coating rollers 51 for cleaning them.

Figure 3:
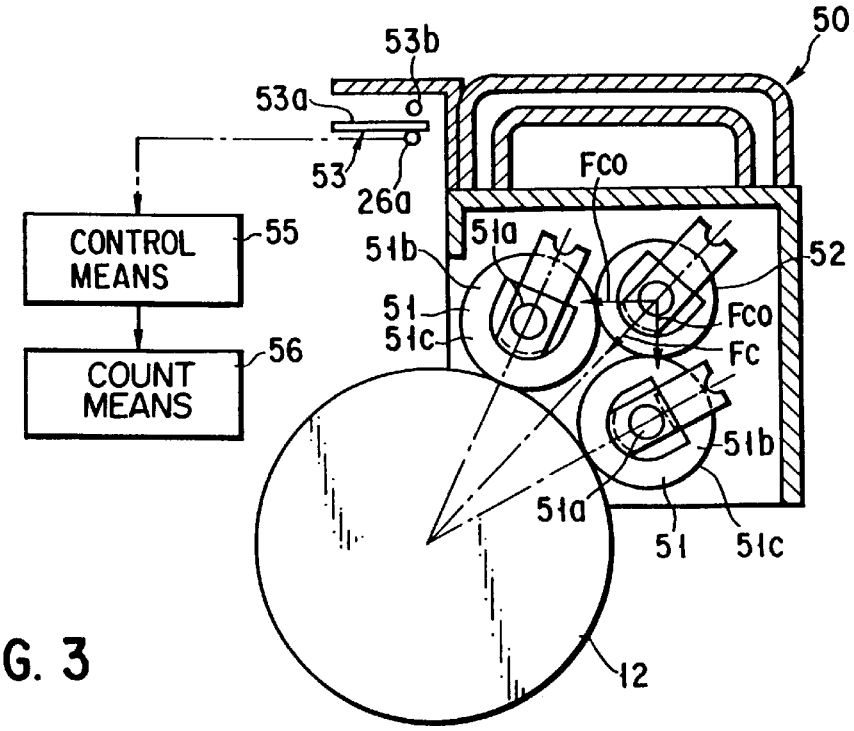
FIG. 3 is a view illustrating an oil coating unit.

FIG. 3 is a view showing the structure of the oil coating unit 50.

As shown, the cleaning roller 52 is interposed between the coating roller 51 such that it contacts them and the distance between the diametrical centers of the roller 52 and one of the coating roller 51 is equal to the distance between those of the roller 52 and the other roller 51. Further, the cleaning roller 52 is urged with a force Fc by a pressure spring (not shown) in a direction indicated by the arrow Fc.

The direction in which the cleaning roller 52 is urged is between the coating rollers 51, and hence the same force Fco is applied to each coating roller 51. Accordingly, the contact area between one of the coating rollers 51 and the fixing roller 12 is substantially the same as that between the other coating roller 51 and the fixing roller 12, and therefore substantially the same amount of oil can be coated on the roller 12 by both coating rollers 51. As a result, the coating rollers 51 have substantially the same oil consumption, which means efficient use of the oil coating unit 50. In other words, since such a case where only one of the coating rollers 51 is worn can be avoided, the entire oil coating unit 50 can have a relatively long life.

The coating roller 51 is formed by, for example, causing dimethyl silicone oil to sink into a heat resisting paper sheet 51*b*, winding the sheet 51*b* on a core bar 51*a*, and coating the sheet-wound core bar with a porous fluorine-based resin 51*c*. In this structure, oil within the coating roller 51 is heated by the heat of the fixing roller 12 and reduced to a low viscosity. As a result, oil seeps from the surface of each coating roller 51 and sticks to the fixing roller 12.

Furthermore, the surface of each coating roller 51 is formed of the fluorine-based resin 51*c* which has a high release characteristic, and hence is prevented from being considerably contaminated with a developer. Even if the surface of the coating roller 51 is slightly contaminated, it is cleaned by the cleaning roller 52, and therefore the oil within it can be used until exhausted.

Depending upon the manner of winding of the heat resisting paper sheet 51*b*, the coating roller 51 can have an uneven surface. If it has an uneven surface, uniform oil coating cannot be realized while the roller 51 rotates. That portion of the roller 51 which is not sufficiently coated with oil has a low release characteristic, and hence the developer may attach thereto.

To prevent partial degradation of the release characteristic and to enable printing of an excellent image, the embodiment employs a plurality (a pair) of coating rollers 51.

Moreover, the employment of plural coating rollers 51 can also extend the life of the oil coating unit 50.

Since, however, the coating rollers 51 of the above structure have their lives (they cannot be used when the internal oil has been exhausted), it is necessary to exchange the oil coating unit 50 for a new one at regular intervals.

To obtain information as to when the exchange should be done, there are provided a detection mechanism 53 for detecting whether or not the oil coating unit 50 is mounted, and count means 56 for counting the life of the oil coating unit 50.

The detection mechanism 53 has a board 53*a* with, for example, a fuse 53*b* mounted thereon. When the oil coating unit 50 is mounted on the fixing unit 26, a terminal 26*a* on the fixing unit 26 side is connected to a contact (not shown) on the fuse board 53*a*, thereby cutting the fuse 53*b*. As a result, the attachment of the oil coating unit 50 is detected.

The detection signal of the detection mechanism 53 is supplied to control means 55, which in turn makes the count means 56 operable.

The count means 56 counts the life of the coating rollers 51 by counting, for example, the number of printed paper sheets or the time for which the fixing roller 12 or the coating rollers 51 rotate. Alternatively, the life may be counted on the basis of the heating time of the fixing roller 12 or the coating rollers 51.

Figure 4:
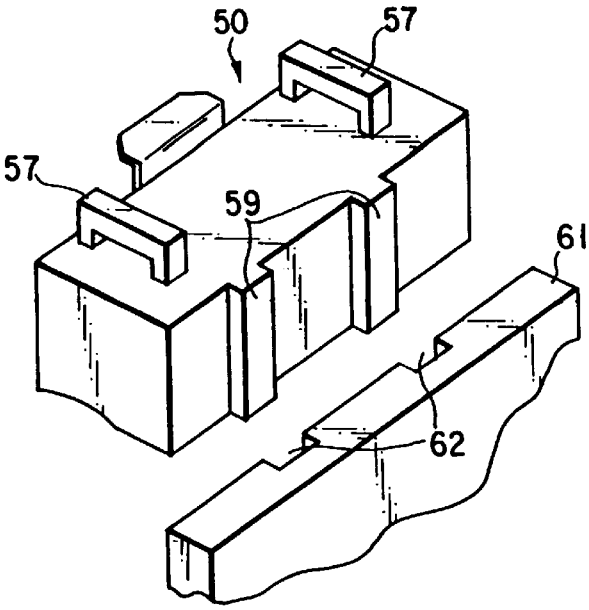
FIG. 4 is a perspective view showing the outward appearance of the oil coating unit and its attaching member.

FIG. 4 is a perspective view of the oil coating unit 50.

Handles 57 are provided on the upper surface of the oil coating unit 50. The shape of the oil coating unit 50 depends upon the length of each coating roller 51, and is substantially a rectangular parallelepiped. Therefore, to stabilize the oil coating unit 50, the points of application, i.e. the points from which the unit 50 is raised, should be placed at longitudinal ends. In light of this, the handles 57 are provided at longitudinal end portions of the oil coating unit 50 in this embodiment.

Also, projections 59 serving as regulating means are vertically formed on back surfaces of the unit 50. On the other hand, guide grooves 62 are formed in a frame (attaching means) 61 incorporated in the fixing unit 26. The projections 59 of the oil coating unit 50 can be engaged with the guide grooves 62 such that they are vertically movable.

The oil coating unit 50 is mounted on the fixing unit 26 by downwardly inserting the projections 59 into the guide grooves 62 of the frame 61 of the unit 26.

When the oil coating unit 50 is exchanged for a new one after the oil within it is exhausted, it is raised with the handles 57 gripped by the hands of the operator, thereby removing the oil coating unit 50 from the frame 61 of the fixing unit 26. After that, a new oil coating unit 50 is carried to a position above the frame 61 of the fixing unit 26, with the handles 57 gripped by the hands. Then, the projections 59 of the new unit 50 are inserted from above into the guide grooves 62 of the frame 61 of the fixing unit 26. Thus, the new oil coating unit 50 is mounted.

Since the oil coating unit 50 is detachably mounted on the fixing unit 26, and the entire oil coating unit 50 is exchanged when the unit 50 should be exchanged, not only a professional maintenance worker but also a general user can perform the exchange without spilling oil.

Since oil is made to sink into the heat resisting paper of the coating rollers 51, it is not possible that the oil will spill from the oil coating unit 50 even if the fixing unit 26 inclines when exchanging the oil coating unit 50.

Furthermore, the structure, in which the oil coating unit 50 is attached by inserting the projections 59 of the unit 50 into the guide grooves 62 of the frame 61, enables accurate mounting of the oil coating unit 50 in a predetermined position.

The projections 59 and the guide grooves 62 may be provided in an opposite manner. Specifically, the apparatus may be modified such that the projections 59 are provided on the frame 61 of the fixing unit 26, while the guide grooves 62 are formed in back surfaces of the oil coating unit 50.

Figure 5:
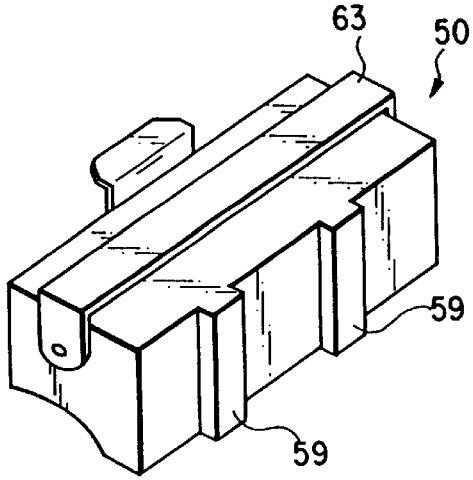
FIG. 5 is a perspective view showing the outward appearance of a modification of the oil coating unit.

Moreover, a handle 63 may be provided on the upper surface of the oil coating unit 50 in a longitudinal direction as shown in FIG. 5.

Figure 6:
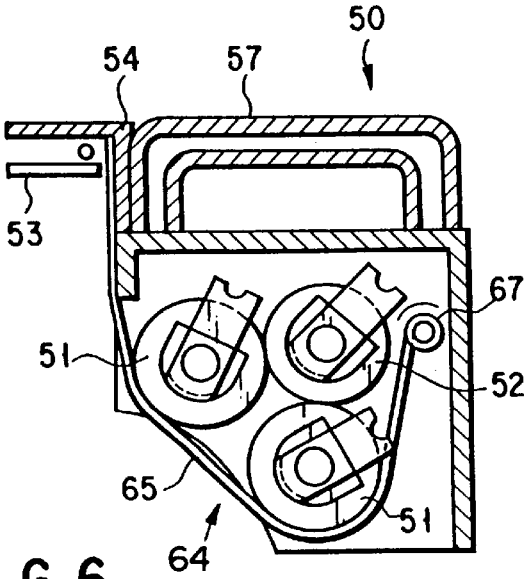
FIG. 6 is a view showing a protective sheet attached to the oil coating unit.

FIG. 6 shows an automatic winding mechanism 64 for automatically winding a protective sheet for the coating rollers 51.

The oil coating unit 50 is an expendable supply and treated as one item. Therefore, while the unit 50 is transported or mounted on the fixing unit 26, it is highly possible that the surfaces of the coating rollers 51 will be contaminated or damaged. To prevent it, a protective sheet 65 as a protective member is provided to cover the coating rollers 51 of the oil coating unit 50. If, however, the user forgets removal of the protective sheet 65, no oil will be supplied to the fixing roller 12, thereby causing a developer to attach thereto and hence causing jam of a paper sheet.

To avoid this, there is provided a mechanism 64 for automatically winding the protective sheet 65. The protective sheet 65 has one end is adhered to or fitted in a case 54 with a small force, and the other end fixed on a winding rod 67. The winding rod 67 is connected to the fixing unit 26 or to a driving section (not shown) incorporated in a copy machine, a printer, etc. The winding rod 67 is rotated by the driving force of the driving section to thereby automatically wind the protective sheet 65 thereon.

To prevent oozing of oil, the protective sheet 65 is preferably formed of a film such as a polyethylene film. However, the sheet 65 may be made of paper, if a resin is coated on or adhered to the paper so as to prevent oozing of oil.

While the protective sheet 65 is wound, it contacts the fixing unit 26. To prevent the fixing unit 26 from being charged with electricity, it is desirable that the surface of the protective sheet 65 should be conductive.

As described above, in the invention, the oil coating unit 50 is detachably attached to the frame 61, and hence even a general user, as well as a professional maintenance worker, can exchange the unit. 50 for another without spilling oil therefrom. Therefore, the downtime of the apparatus can be minimized.

Further, since oil is contained in the coating rollers 51, it will not spill from the apparatus even when the fixing unit 26 is inclined, which enhances the reliability of the apparatus.

Furthermore, the cleaning roller 52 for removing a developer from the surfaces of the coating rollers 51 can protect the rollers 51 from contamination, which enables constant supply of oil to the fixing roller 12 and hence further extension of life of the apparatus.

Also, since the cleaning roller 52 is provided in a position in which an equal force can be applied to both the coating rollers 51, the contact area of the fixing roller 12 and one of the coating rollers 51 is substantially the same as that of the fixing roller 12 and the other coating roller 51. Accordingly, the coating rollers 51 have substantially the same oil consumption and therefore substantially the same life span, with the result that the oil coating unit 50 can be used efficiently.

Since the coating rollers 51 have their surfaces constituted of a fluorine-based resin, they have a higher resistance against contamination and a longer life than conventional coating rollers.

Moreover, the life of the oil coating unit 50 can be expected, and a message to exchange it for a new one can be supplied to the user. Therefore, the user can obtain a new oil coating unit 50 before the mounted oil coating unit 50 is exhausted. This can reduce the exchange time.

Since there are provided convex and concave sections 59 and 62 for regulating the attachment direction of the oil coating unit 50, the unit 50 can be mounted correctly.

Further, since the oil coating unit 50 has the handles 57 located at the longitudinal opposite ends, or the handle 63 extending longitudinal with respect to the oil coating rollers 51, the user can hold the oil coating unit 50 in a stable manner and can treat it easily.

In addition, since the protective sheet 65 is provided in the oil coating unit 50 for protecting the coating rollers 51, the surfaces of the rollers 51 are protected from being contaminated or damaged.

Since the fixing unit 26 incorporates the winding mechanism 64 for automatically winding the protective sheet 65 when the oil coating unit 50 has been mounted, the unit 26 is free from a disadvantage such as a jam of a paper sheet due to the adhesion of toner to the unit, which will be caused when removal of the protective sheet 65 has been forgotten and oil has not been applied to the fixing roller 12.

Since the protective sheet 65 is made of a synthetic resin, spilling of oil to the outside, for example, can be prevented.

Further, since the protective sheet 65 has conductivity, the fixing roller 12 is prevented from being charged, and accordingly electrostatic attachment of a paper sheet to the fixing roller 12 is avoided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing unit comprising:

fixing means for fixing an image of a developer transferred onto a transfer medium;

oil supply means for supplying the fixing means with oil to prevent the developer from attaching to the fixing means, the oil supply means including supply roller means which contains oil, and a removing roller for removing the developer attached to the supply roller means; and attaching means for detachably attaching the oil supply means to the fixing means, wherein the supply roller means of the oil supply means consists of a plurality of supply rollers, and the plurality of supply rollers are made to put in pressure contact with the removing roller by substantially the same pressure.

2. A fixing unit according to claim 1, wherein the supply roller means includes a core bar, an impregnated member wound on the core bar and impregnated with oil, and a porous material covering the impregnated member.

3. A fixing unit according to claim 1, wherein the oil supply means and the attaching means have regulating means for regulating the direction of attachment of the oil supply means to the attaching means.

4. A fixing unit according to claim 3, wherein the regulating means includes a convex section provided on one of the oil supply means and the attaching means, and a concave section provided in the other of the oil supply means and the attaching means and to be engaged with the convex section.

5. A fixing unit according to claim 4, wherein the regulating means regulates the oil supply means and the attaching means such that the oil supply means is attached to the attaching means by vertically inserting the convex section into the concave section.

6. A fixing unit comprising:

fixing means for fixing an image of a developer transferred onto a transfer medium;

oil supply means for supplying the fixing means with oil to prevent the developer from attaching to the fixing means, the oil supply means including supply roller means which contains oil, and a removing roller for removing the developer attached to the supply roller means; and attaching means for detachably attaching the oil supply means to the fixing means, wherein the supply roller means includes a core bar, an impregnated member wound on the core bar and impregnated with oil, and a porous material covering the impregnated member, and wherein the impregnated member has a heat resistance, and the porous material is a fluorine-based resin.

7. A fixing unit comprising:

fixing means for fixing an image of a developer transferred onto a transfer medium;

oil supply means for supplying the fixing means with oil to prevent the developer from attaching to the fixing means, the oil supply means including supply roller means which contains oil, and a removing roller for removing the developer attached to the supply roller means; and attaching means for detachably attaching the oil supply means to the fixing means, wherein the oil supply means has handles provided on longitudinal opposite ends thereof with respect to the supply roller means, or a handle provided thereon and extending longitudinal with respect to the supply roller means.

8. A fixing unit comprising:

fixing means for fixing an image of a developer transferred onto a transfer medium;

oil supply means for supplying the fixing means with oil to prevent the developer from attaching to the fixing means, the oil supply means including supply roller means which contains oil, and a removing roller for removing the developer attached to the supply roller means;

attaching means for detachably attaching the oil supply means to the fixing means; and a protective member for protecting the supply roller means of the oil supply means.

9. A fixing unit according to claim 8, wherein the protective member is formed of a synthetic resin having a conductivity.

10. A fixing unit according to claim 8, further comprising winding means for winding the protective member when the oil supply means is attached to the attaching means.

11. An image forming apparatus comprising:

a plurality of image carriers for carrying images;

a plurality of image forming means for forming developer images of different colors on the plurality of image carriers;

a plurality of transfer means for transferring the developer images formed by the plurality of image forming means, onto a transfer medium;

fixing means for fixing the developer images transferred onto the transfer medium by the plurality of transfer means;

oil supply means for supplying the fixing means with oil to prevent the developer from attaching to the fixing means, the oil supply means including a plurality of supply rollers which contain oil, and a removing roller for removing the developer attached to the plurality of supply rollers;

attaching means for detachably attaching the oil supply means to the fixing means; and count means for counting the life of the oil supply means, wherein the plurality of supply rollers are made to put in pressure contact with the removing roller by substantially the same pressure.

12. A fixing unit according to claim 11, wherein the count means is operable when the oil supply means is attached to the attaching means.

13. A fixing apparatus comprising:

an image fixing unit that fixes an image of a developer transferred onto a transfer medium;

an oil supply unit that supplies the image fixing unit with oil to prevent the developer from attaching to the image fixing unit, the oil supply unit including a plurality of supply rollers which contain oil, and a removing roller for removing the developer attached to the plurality of supply rollers; and an attaching unit that detachably attaches the oil supply unit to the image fixing unit, wherein the plurality of supply rollers are made to put in pressure contact with the removing roller by substantially the same pressure.

14. A fixing apparatus comprising:

an image fixing unit that fixes an image of a developer transferred onto a transfer medium;

an oil supply unit that supplies the image fixing unit with oil to prevent the developer from attaching to the image fixing unit, the oil supply unit including a plurality of supply rollers which contain oil, and a removing roller for removing the developer attached to the plurality of supply rollers; and an attaching unit that detachably attaches the oil supply unit to the image fixing unit, wherein the oil supply unit has handles provided on longitudinal opposite ends thereof with respect to the plurality of supply rollers, or a handle provided thereon and extending longitudinal with respect to the plurality of supply rollers.

15. A fixing apparatus comprising:

an image fixing unit that fixes an image of a developer transferred onto a transfer medium;

an oil supply unit that supplies the image fixing unit with oil to prevent the developer from attaching to the image fixing unit, the oil supply unit including a plurality of supply rollers which contain oil, and a removing roller for removing the developer attached to the plurality of supply rollers;

an attaching unit that detachably attaches the oil supply unit to the image fixing unit; and a protective member that protects the plurality of supply rollers of the oil supply unit.

16. An image forming apparatus comprising:

a plurality of image carriers for carrying images;

a plurality of image forming means for forming developer images of different colors on the plurality of image carriers;

a plurality of transfer means for transferring the developer images formed by the plurality of image forming means, onto a transfer medium;

fixing means for fixing the developer images transferred onto the transfer medium by the plurality of transfer means;

oil supply means for supplying the fixing means with oil to prevent the developer from attaching to the fixing means, the oil supply means including a plurality of supply rollers which contain oil, and a removing roller for removing the developer attached to the plurality of supply rollers;

attaching means for detachably attaching the oil supply means to the fixing means; and count means for counting the life of the oil supply means, wherein each of the plurality of supply rollers includes a core bar, an impregnated member wound on the core bar and impregnated with oil, and a porous material covering the impregnated member, and wherein the impregnated member has a heat resistance, and the porous material is a fluorine-based resin.

17. An image forming apparatus comprising:

a plurality of image carriers for carrying images;

a plurality of image forming means for forming developer images of different colors on the plurality of image carriers;

a plurality of transfer means for transferring the developer images formed by the plurality of image forming means, onto a transfer medium;

fixing means for fixing the developer images transferred onto the transfer medium by the plurality of transfer means;

oil supply means for supplying the fixing means with oil to prevent the developer from attaching to the fixing means, the oil supply means including a plurality of supply rollers which contain oil, and a removing roller for removing the developer attached to the plurality of supply rollers;

attaching means for detachably attaching the oil supply means to the fixing means; and count means for counting the life of the oil supply means, wherein the oil supply means has handles provided on longitudinal opposite ends thereof with respect to the plurality of supply rollers, or a handle provided thereon and extending longitudinal with respect to the plurality of supply rollers.

18. An image forming apparatus comprising:

a plurality of image carriers for carrying images;

a plurality of image forming means for forming developer images of different colors on the plurality of image carriers;

a plurality of transfer means for transferring the developer images formed by the plurality of image forming means, onto a transfer medium;

fixing means for fixing the developer images transferred onto the transfer medium by the plurality of transfer means;

oil supply means for supplying the fixing means with oil to prevent the developer from attaching to the fixing means, the oil supply means including a plurality of supply rollers which contain oil, and a removing roller for removing the developer attached to the plurality of supply rollers;

attaching means for detachably attaching the oil supply means to the fixing means;

count means for counting the life of the oil supply means; and a protective member for protecting the plurality of supply rollers of the oil supply means.

19. An image forming apparatus comprising:

a plurality of image carriers for carrying images;

a plurality of image forming units that respectively form developer images of different colors on the plurality of image carriers;

a plurality of transfer units that respectively transfer the developer images formed by the plurality of image forming units, onto a transfer medium;

a fixing unit that fixes the developer images transferred onto the transfer medium by the plurality of transfer units;

an oil supply unit that supplies the fixing unit with oil to prevent the developer from attaching to the fixing unit, the oil supply unit including a plurality of supply rollers which contain oil, and a removing roller for removing the developer attached to the plurality of supply rollers;

an attaching unit that detachably attaches the oil supply unit to the fixing unit; and a count unit that counts the life of the oil supply unit, wherein each of the plurality of supply rollers includes a core bar, an impregnated member wound on the core bar and impregnated with oil, and a porous material covering the impregnated member, and wherein the impregnated member has a heat resistance, and the porous material is a fluorine-based resin.

20. An image forming apparatus comprising:

a plurality of image carriers for carrying images;

a plurality of image forming units that respectively form developer images of different colors on the plurality of image carriers;

a plurality of transfer units that respectively transfer the developer images formed by the plurality of image forming units, onto a transfer medium;

a fixing unit that fixes the developer images transferred onto the transfer medium by the plurality of transfer units;

an oil supply unit that supplies the fixing unit with oil to prevent the developer from attaching to the fixing unit, the oil supply unit including a plurality of supply rollers which contain oil, and a removing roller for removing the developer attached to the plurality of supply rollers;

an attaching unit that detachably attaches the oil supply unit to the fixing unit; and a count unit that counts the life of the oil supply unit, wherein the oil supply unit has handles provided on longitudinal opposite ends thereof with respect to the plurality of supply rollers, or a handle provided thereon and extending longitudinal with respect to the plurality of supply rollers.

21. An image forming apparatus comprising:

a plurality of image carriers for carrying images;

a plurality of image forming units that respectively form developer images of different colors on the plurality of image carriers;

a plurality of transfer units that respectively transfer the developer images formed by the plurality of image forming units, onto a transfer medium;

a fixing unit that fixes the developer images transferred onto the transfer medium by the plurality of transfer units;

an oil supply unit that supplies the fixing unit with oil to prevent the developer from attaching to the fixing unit, the oil supply unit including a plurality of supply rollers which contain oil, and a removing roller for removing the developer attached to the plurality of supply rollers;

an attaching unit that detachably attaches the oil supply unit to the fixing unit; and a count unit that counts the life of the oil supply unit; and a protective member for protecting the plurality of supply rollers of the oil supply unit.

* * * * *